United States Patent [19]

Herrera

[11] Patent Number: 4,871,890

[45] Date of Patent: Oct. 3, 1989

[54] EASILY ASSEMBLEABLE PUSH-BUTTON SWITCH

[76] Inventor: Ricardo R. Herrera, C. Pi i Margall, 165 08830 Sant Boi De Llobregat, Barcelona, Spain

[21] Appl. No.: 173,421

[22] Filed: Mar. 25, 1988

[30] Foreign Application Priority Data

Mar. 25, 1987 [ES] Spain ..... 8700825

[51] Int. Cl.[4] ..... H01H 9/16

[52] U.S. Cl. ..... 200/314; 200/341

[58] Field of Search ..... 200/314, 340, 341

[56] References Cited

U.S. PATENT DOCUMENTS 3,895,205 7/1975 Tharp ..... 200/340
4,354,078 10/1982 Yoshimura ..... 200/314
4,360,722 11/1982 Georgopulos ..... 200/314
4,733,036 3/1988 Koizumi et al. ..... 200/340

*Primary Examiner*—Renee S. Luebke
*Attorney, Agent, or Firm*—Steinberg & Raskin

[57] ABSTRACT

A switch having a button, and a casing in which the button is seated, at least part of the casing being formed into a substantially tubular body. A driver is coupled to the button and is at least partially mounted in the tubular body for axial displacement therein. A socket body is mounted to extend within the tubular body from an end opposite the button and has at least one opening and at least one notch, with the tubular body having at least one leg at an end thereof opposite the button which is coupled to the socket through the opening and at least one projection extending from the end opposite the button and which is situated to seat within the notch, when the switch is assembled.

3 Claims, 2 Drawing Sheets

EASILY ASSEMBLEABLE PUSH-BUTTON SWITCH

BACKGROUND OF THE INVENTION

The present invention relates to a switch with a push-button and incorporated lamp, of the type which comprises a tubular body integral at one end thereof with a case in which a translucent push-button is situated and connected to an axially displaceable driver mounted within the tubular body. A spring actuates or biases the driver towards a disconnect position, the driver acting upon a microswitch which, in turn, is mounted on a socket body situated inside the same tubular body and pressure-coupled at a rear end thereof.

Known arrangements of switches of the type described above, have various disadvantages. One disadvantage is difficulty of separating a tubular body from a socket, because the socket and body are coupled by means of an arrangement of complementary annular ribs and grooves which fit tightly. Another disadvantage is that due to the mounting of the driver within the tubular body, with the spring acting to maintain the driver in floating condition and being situated between legs of the driver, the spring easily detaches therefrom during the mounting operation. Finally, it should be pointed out that there are no effective means for centering and for immobilizing or stopping rotation between the driver and the socket.

SUMMARY OF THE INVENTION

Accordingly, it is an object of the present invention to eliminate the disadvantages encountered in prior art switches noted above.

It is also an object of the present invention to facilitate assembly and disassembly of a switch such as a push-button switch.

It is an additional object of the present invention to ensure reliable engagement between various components of a switch after it is assembled or mounted.

It is another object of the present invention to provide for effective centering of components of an assembled switch, and to prevent unwanted shifting or movement of the same.

These and other objects are attained by the present invention which is directed to a switch comprising a button, and a casing in which the button is seated, with at least part of the casing being formed into a substantially tubular body. A driver is coupled to the button and at least partially mounted in the tubular body for axial displacement therein. Furthermore, a socket body is mounted to extend within the tubular body from an end thereof opposite the button.

The socket body comprises at least one opening, with the tubular body comprising at least one leg at an end thereof opposite the button which is coupled to the socket through the opening, when the switch is assembled. Furthermore, the socket body comprises at least one notch and the tubular body comprises at least one projection extending from the end thereof opposite the button and situated to seat within the notch when the switch is assembled.

Preferably, the socket body comprises a plurality of openings and a plurality of notches, with the tubular body comprising a plurality of legs and a plurality of projections, each leg being mounted to be coupled to the socket body in a respective opening and each projection mounted to be seated within a respective notch when the switch is assembled. Thereby, the socket body is substantially centered and immobilized when the switch is so assembled.

The tubular body may additionally comprise a neck-shaped coaxial prolongation at the end opposite the button, with the legs and projections being mounted upon this prolongation of the tubular body. Each leg may additionally comprise a fastening barb or tooth on an end thereof for locking the leg into the respective opening when the switch is assembled, with each leg preferably being elastic. Furthermore, each leg and adjacent projection may be separated from one another by a substantially radially-extending spacing through the tubular body. The legs and projections are preferably substantially equidistantly spaced around the neck-shaped prolongation in a circumferential direction thereof.

Thus, all of the above-noted disadvantages are overcome with a push-button switch and incorporated light in accordance with the present invention, which is easy to manufacture and which can be assembled and disassembled in a very simple, uncomplicated manner, without adversely affecting safe and reliable coupling between the various switch components, contrary to the previously-used switches.

The switch of the present invention is essentially characterized by the tubular body having, at an inner end, a neck-shaped coaxial prolongation, on which elastic legs with barbs or teeth are formed, and which engage, under pressure, in openings provided for this effect in the socket which is kept coupled and immobilized by the legs and also due to the presence of the projections of the noted neck which engage or are seated in notches provided in the socket itself.

Furthermore, the driver or driver body has an outer annular seat on which a helical spring rests or is mounted, externally surrounding legs of the driver and resting at an opposite end on bent vanes or tabs at the ends of the driver legs themselves, before the driver is placed or situated inside the tubular body, so that the spring is perfectly immobilized and does not undesirably shift or move to improper position.

Therefore, the present invention is directed to a switch with a push-button and incorporated lamp, of the type which comprises a tubular body integral at one end with a case in which a translucent push-button is situated, the push-button being connected to an axially displaceable driver situated in the tubular body. A spring actuates or biases the driver towards a disconnect position, the driver acting upon a microswitch which, in turn, is mounted in a socket body situated inside the same tubular body and pressurecoupled thereto at the rear end thereof. The tubular body, has, at its inner end, a neck-shaped coaxial prolongation on which elastic legs with barbs are formed, the barbs engaging, under pressure, in openings provided to this effect in the socket which is kept coupled thereto and immobilized by the legs and also due to the presence of projections of the noted neck which engage or extend into notches provided in the socket. The driver or driver body may be provided with an outer annular seat on which the helical spring rests to externally surround legs of the driver and rests, at an end opposite the seat, on bent vanes which are situated at the ends of the legs before the driver is situated in the interior of the tubular body, so that the spring is perfectly immobilized.

BRIEF DESCRIPTION OF THE DRAWINGS

For better comprehension and understanding, the present invention will be further described in greater detail with reference to the accompanying drawings which are presented for exemplary purposes only, and illustrate one practical embodiment of the switch herein. In the drawings

DESCRIPTION OF THE PREFERRED EMBODIMENTS

Figure 1:
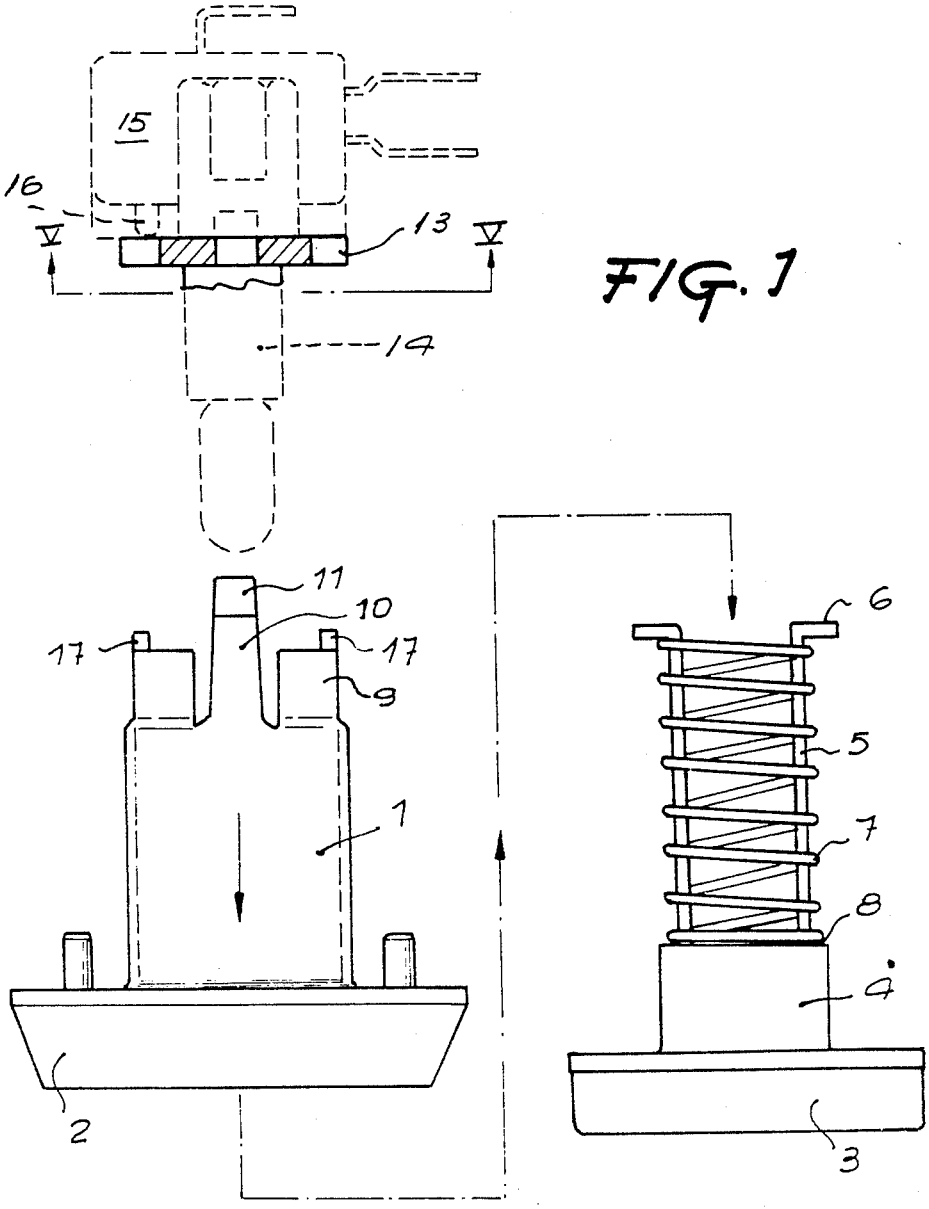
FIG. 1 is a side elevational view of a disassembled switch in accordance with the present invention.

Referring to the drawings, a switch with a push-button and incorporated light comprises an outer tubular body 1 having a rear screwthread for a fastening nut of the switch on a control panel of the apparatus in which the switch is to be incorporated. One end of the tubular body 1 is formed into a case 2 in which a push-button 3 is partially situated and guided, the button 3 having a translucent cover that forms part of a sleeve or neck 4 which is extended to form two long and elastic legs 5 with bent driver tabs or vanes 6 at the ends thereof, as illustrated.

A spring 7 is situated about or around the legs 5, with one end of the spring resting on an outer annular seat 8 situated between the neck or sleeve 4 and the legs 5, and, before the driver assembly is placed or situated inside the tubular body 1 (FIG. 1), the other end of the spring resting on the tabs or vanes 6.

Figure 2:
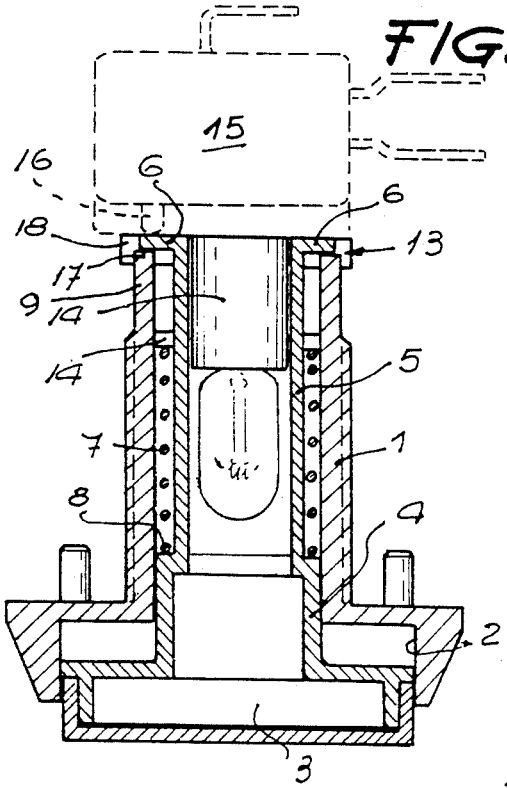
FIG. 2 is a longitudinal sectional view of the assembled switch in accordance with the present invention.
Figure 3:
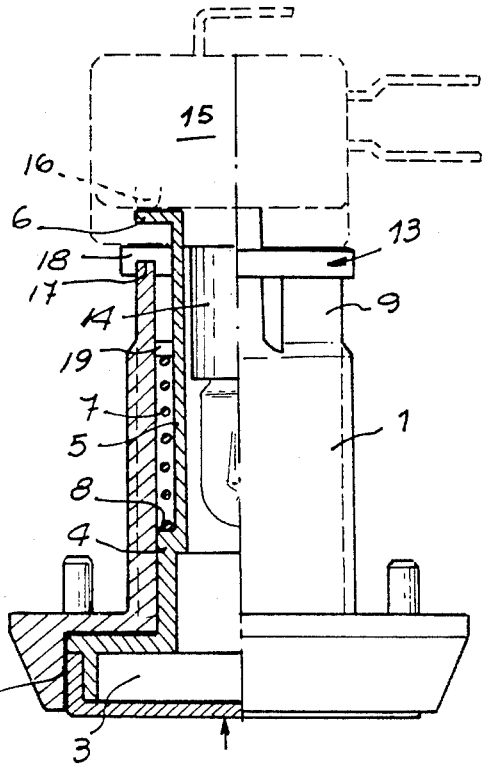
FIG. 3 is a one-quarter longitudinal sectional view of a switch in accordance with the present invention, with a push-button and driver in operating position.
Figure 4:
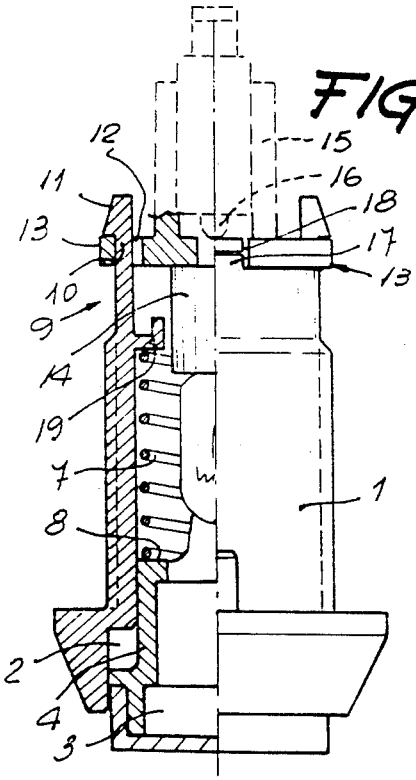
FIG. 4 is a one-quarter longitudinal sectional view along a plane normal to the view of the FIG. 3, with the switch of the invention being in rest or disconnected position.
Figure 5:
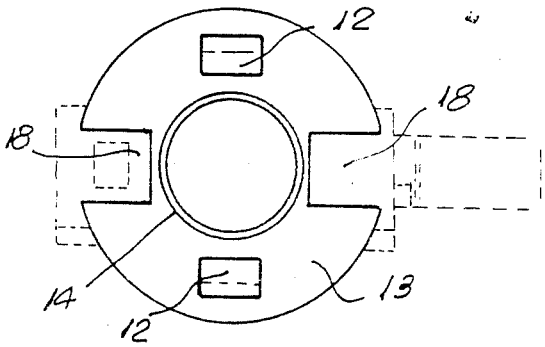
FIG. 5 is a view along line V—V of FIG. 1.

The inner end of the tubular body 1 is provided with a coaxial neck 9 in turn provided with two elastic legs 10 with teeth or barbs 11 on an end thereof, intended to engage in openings 12 provided in a flange 13 of a socket body 14 which is also provided with a microswitch 15 known per se, a push-button 16 of which is actuated by one of the tabs 6 of the legs 5 as illustrated. A light is situated on the socket 14 and within the tubular body 1 as best seen in FIG. 2.

The neck 9 is provided with projections 17 which extend into or engage in notches 18 of the flange 13 of the socket body 14 to immobilize and center the socket piece 14 relative to the tubular body 1.

From the proceeding description and the accompanying drawings, the advantages provided by a push-button switch of the present invention are quite evident. These advantages include the following:

(a) Ease of assembly and disassembly due to provision of the elastic legs 10 on the tubular body 1, with the teeth or barbs 11 thereof engaging in the openings 12 in the flange 13 of the socket body 14;

(b) Centering of the flange 13, socket body 14 due to the projections 17 seating or engaging in the notches 18; and (c) Simplification or the facilitation of assembly and disassembly of the driver group 4, 5 and 6 with the spring 7, due to the spring 7 being seated and immobilized between the seat or step 8 and the tabs 6, before insertion. After the driver group 4, 5, 6 is appropriately installed as illustrated, the spring is then seated on an inner stop 19 of the body 1.

The preceding description of the present invention is merely exemplary, and is not intended to limit the scope thereof in any way.

What is claimed is:

1. A switch, comprising a button, a casing in which said button is seated, at least part of said casing being formed into a substantially tubular body, a driver coupled to said button and at least partially mounted in said tubular body for axial displacement therein, a socket body mounted to extend within said tubular body from an end thereof opposite said button, wherein said socket body comprises at least one opening and said tubular body comprises at least one leg at said end thereof opposite said button which is coupled to said socket through said opening when said switch is assembled, and said socket body comprises at least one notch and said tubular body comprises at least one projection extending from said end thereof opposite said button and situated to seat within said notch when said switch is assembled, a microswitch mounted on said socket body, means for biasing said driver away from said microswitch, wherein said driver additionally comprises a sleeve or neck connected to said button and defining an outer annular seat at one end of said driver, and a pair of legs mounted upon said sleeve or neck and extending away from said button, each said leg having a bent vane or tab on an end thereof remote from said sleeve or neck, and said biasing means comprise a helical spring mounted at one end thereof on said outer annular seat and, prior to assembly of said driver into said tubular body, mounted at an opposite end thereof on said bent vanes or tabs.

2. The combination of claim 1, wherein said tubular body additionally comprises a substantially radially-extending stop situated in an interior thereof between said opposite ends thereof, with said spring end opposite said annular seat being seated on said inner stop when said switch is assembled.

3. The combination of claim 1, wherein said microswitch additionally comprises a projection extending out therefrom and situated to be depressed by one of said bent tabs or vanes when said button is depressed.

* * * * *

UNITED STATES PATENT AND TRADEMARK OFFICE

CERTIFICATE OF CORRECTION

PATENT NO. : 4,871,890

DATED : October 3, 1989

INVENTOR(S) : Ricardo Romero Herrera

It is certified that error appears in the above-identified patent and that said Letters Patent is hereby corrected as shown below:

On the title page, the inventor name should be:

-- Ricardo Romero Herrera --.

Signed and Sealed this

Ninth Day of October, 1990

*Attest:*

*Attesting Officer*

HARRY F. MANBECK, JR.

*Commissioner of Patents and Trademarks*